US005928009A

United States Patent [19]

Lee

[11] Patent Number: 5,928,009

[45] Date of Patent: Jul. 27, 1999

[54] COMMUNICATIONS CARD CAPABLE OF DIRECTLY CONNECTING TO A BNC

[75] Inventor: Ju-Heon Lee, Seoul, Rep. of Korea

[73] Assignee: SamSung Electronics Co., Ltd., Suwon, Rep. of Korea

[21] Appl. No.: 08/917,065

[22] Filed: Aug. 25, 1997

[30] Foreign Application Priority Data

Aug. 23, 1996 [KR] Rep. of Korea ..... 96-35127

[51] Int. Cl.[6] ..... H01R 13/44

[52] U.S. Cl. ..... 439/131; 439/638; 439/946

[58] Field of Search ..... 439/76.1, 131, 439/638, 945, 946

[56] References Cited

U.S. PATENT DOCUMENTS

| | | | |
|---|---|---|---|
| 5,183,404 | 2/1993 | Aldous et al. | 439/55 |
| 5,457,601 | 10/1995 | Georgopulos et al. | 361/686 |
| 5,487,681 | 1/1996 | Star et al. | 439/581 |
| 5,509,811 | 4/1996 | Homic | 439/55 |
| 5,540,601 | 7/1996 | Botchek | 439/502 |
| 5,562,504 | 10/1996 | Moshayedi | 439/638 |
| 5,608,607 | 3/1997 | Dittmer | 361/686 |
| 5,637,018 | 6/1997 | Gargiulo | 439/640 |
| 5,660,568 | 8/1997 | Moshayedi | 439/654 |

*Primary Examiner*—Neil Abrams
*Assistant Examiner*—Barry M. L. Standig
*Attorney, Agent, or Firm*—Robert E. Bushnell, Esq.

[57] ABSTRACT

A communications card, PCMCIA card, with a retractable BNC connector receptacle built into one edge of the card. The BNC connector receptacle can be rectangular or have an X-shape and is thinner than the PCMCIA card when retracted. The retractable BNC connector receptacle allows the PCMCIA card to directly interface with an external BNC connector without using an adapter. Having a retractable receptacle makes it easier to store the PCMCIA card and built-in connector. This new communications card and BNC connector receptacle will increase the efficiency of computer use and will increase the ease of data transmission.

9 Claims, 7 Drawing Sheets

COMMUNICATIONS CARD CAPABLE OF DIRECTLY CONNECTING TO A BNC

CLAIM OF PRIORITY

This application makes reference to, incorporates the same herein, and claims all rights accruing thereto under 35 U.S.C. §119 through my patent application entitled *A PCMCIA Card Capable of Directly Connecting to a BNC Connector* earlier filed in the Korean Industrial Property Office on the 23rd day of Aug. 1996 and there duly assigned Ser. No. 1996/35127.

BACKGROUND OF THE INVENTION

1. Field of the Invention

The current invention relates to the interfacing of a communications card and a BNC connector and, more particularly, to a PCMCIA card, a communications card that meets the standards set forth by the Personal Computer Memory Card International Association, having a retractable BNC connector receptacle for directly engaging with BNC connectors.

2. Description of the Related Art

The increasing use of "lap-tops", portable computers, has resulted in a increase in the use of PCMCIA cards. The PCMCIA card connects to a computer using a specially configured peripheral port. The PCMCIA cards and corresponding ports come in one of three standard types, type I, type II, or type III. PCMCIA cards allow a computer to interface with other devices, such as a modem, compact disk read only memory, speaker system, local area networks, or cellular equipment, without having to take off the computer's cover and add additional boards or cards.

The popularity of PCMCIA cards has led to the development of various ways to interface the cards with a growing variety of instruments and devices. By way of example, U.S. Pat. No. 5,183,404 to Aldous entitled *Systems for Connecting of Physical/Electrical Media Connectors to Computer Communications Cards*, shows a PCMCIA card with a retractable jack receptacle for telephone and LAN line jacks. U.S. Pat. No. 5,562,504 to Moshayedi entitled *Communications Card With Integral Transmission Media Line Adaptor*, shows a PCMCIA card that has a separable adapter built into a corner of the card. This allows a comer of the card to be detached and inserted into the PCMCIA socket. Moshayedi '504 further shows a separable comer adapter that has an rotatable upper lid to for engaging a RJ-11 telephone jack. U.S. Pat. No. 5,637,018 to Gargiulo entitled *Hi-Jack Hinged Connection Adapter for Input/Output Cards*, mentions a hinged adapter to connect a PCMCIA card to a telephone jack. U.S. Pat. No. 5,540,601 to Botchek entitled *Adapter for Computer Interface*, uses a PCMCIA adapter to interface a first computer, through the PCMCIA card, with a second computer, through its SCSI port.

U.S. Pat. No. 5,487,681 to Star entitled *Pin BNC Coaxial Cable Connector Receptacle*, shows a square female BNC connector receptacle used to connect with a male BNC connector. This allows non-standard female BNC receptacles to engage BNC connectors without using an adapter.

I have observed that the inability to attach a PCMCIA card to a BNC connector without an adapter restricts the usefulness and productivity of some computers. As such, I expect that it would be desirable to interface a BNC connector directly with a PCMCIA card. The direct connection will prevent users from always needing to remember to carry an adapter unit, along with their computer. Adapters also tend to be easily lost, are commonly bulky and can make it difficult to function in a tight workspace. To be most useful, I expect that the connector used should be difficult to break when the BNC interface is not being used or while the computer is being transported. However, the thickness of the conventional PCMCIA card is less than that of the BNC connector which prevents a typical BNC connector from being attached to a PCMCIA card. As such, I believe that it would be desirable to use a BNC connector receptacle that is thinner than a PCMCIA card.

SUMMARY OF THE INVENTION

It is an object of the current invention to provide an improved process and connector for forming an interface directly between a PCMCIA card and a BNC connector.

It is another object to provide a process and an apparatus to enable a BNC connector to mate directly with a PCMCIA card.

It is yet another object to provide an interface for connecting a BNC connector to a PCMCIA card that will not be easily broken when the computer and PCMCIA card are transported.

It is still yet another object to provide a BNC connector receptacle that is thinner than the height of the PCMCIA card so that the BNC connector receptacle can be retracted into the housing of a PCMCIA card.

It is a further object to provide an interface that is not likely to break while being stored.

These and other objects may be achieved by constructing a PCMCIA card that has a special BNC connector receptacle built into one edge of the card. The BNC receptacle body is rectangular in shape and is thinner than the PCMCIA card. The receptacle is located on an edge of the card. This allows the PCMCIA card to directly interface with an external BNC connector without needing an adapter. The retractable receptacle makes it easier to store the PCMCIA card and built-in connector. The retractable receptacle also simplifies transporting the computer between different work locations without the fear of damaging the BNC connector receptacle. This new PCMCIA card can be inserted into a computer either before or after connecting the card to an external BNC connector. I expect that the direct interfacing of PCMCIA cards and BNC connectors will increase the efficiency of computer use and will increase the ease of data transmission.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DESCRIPTION OF THE PREFERRED EMBODIMENTS

Figure 1:
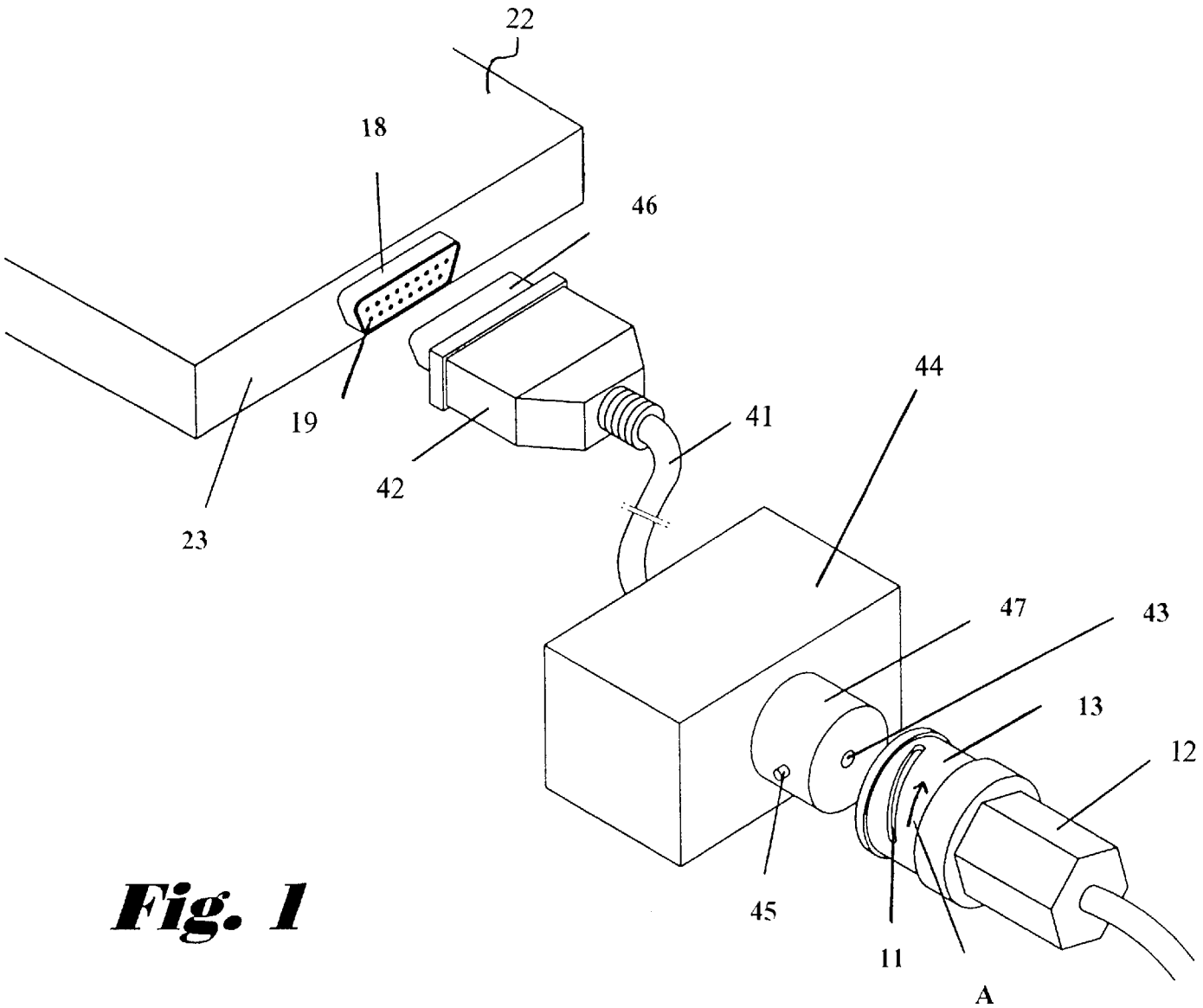
FIG. 1 is an exploded view showing an exemplar PCMCIA card and an adapter for connecting the card to a BNC connector.

Turning now to the drawings, as shown in FIG. 1, a typical PCMCIA card 22 has a connection port 18, on the edge 23 that faces the opening of the computer peripheral port (not shown), for attaching a PCMCIA card connector 42. The connector has shielded pins 46 that mate with the pin holes 19 in the connection port 18. The connector 42 is connected to a BNC adapter 44 by a cable 41. The adapter 44 has a female BNC connector receptacle 43 with projections 45 for engaging the guide holes 11 in the BNC shielding 13 of a BNC connector 12. Once the projections 45 engage the guide holes 11, the BNC connector is rotated in the direction shown by arrow 'A' to connect the BNC connector shield 13 and the BNC connector body 47.

Figure 2:
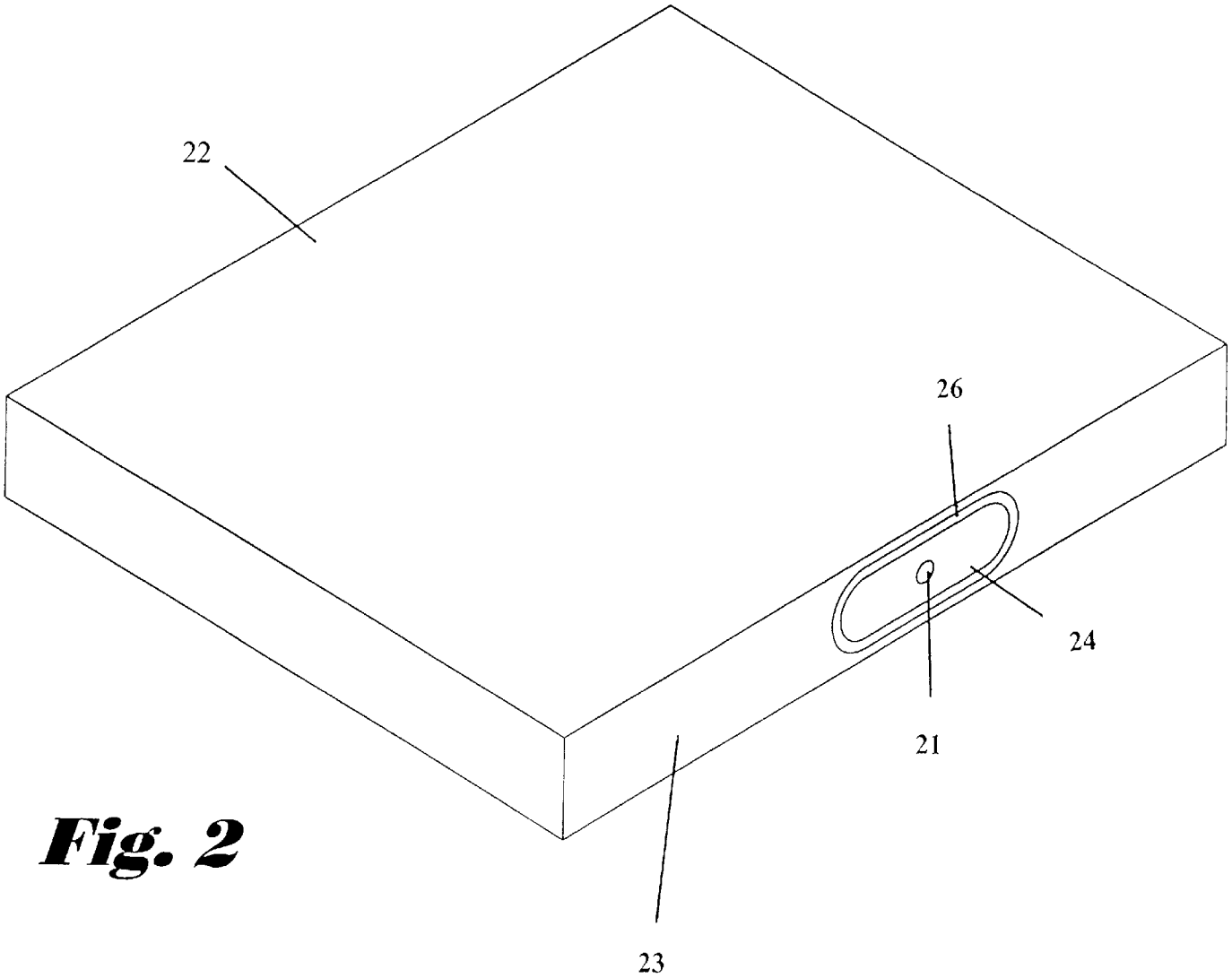
FIG. 2 is a perspective view of a BNC connector receptacle fully inserted into the inside of a PCMCIA card.

FIG. 2 shows the a PCMCIA card 22 with its BNC receptacle body 24, which is fully inserted into the PCMCIA card, and the surrounding opening 26. This receptacle position is ideal for storage and for protecting the receptacle during transport. To extend the BNC connector receptacle 21 from the PCMCIA card, the user presses the BNC receptacle body 24 and it is projected from the PCMCIA card 22 by the force of a spring (not shown) embedded inside the PCMCIA card.

Figure 3:
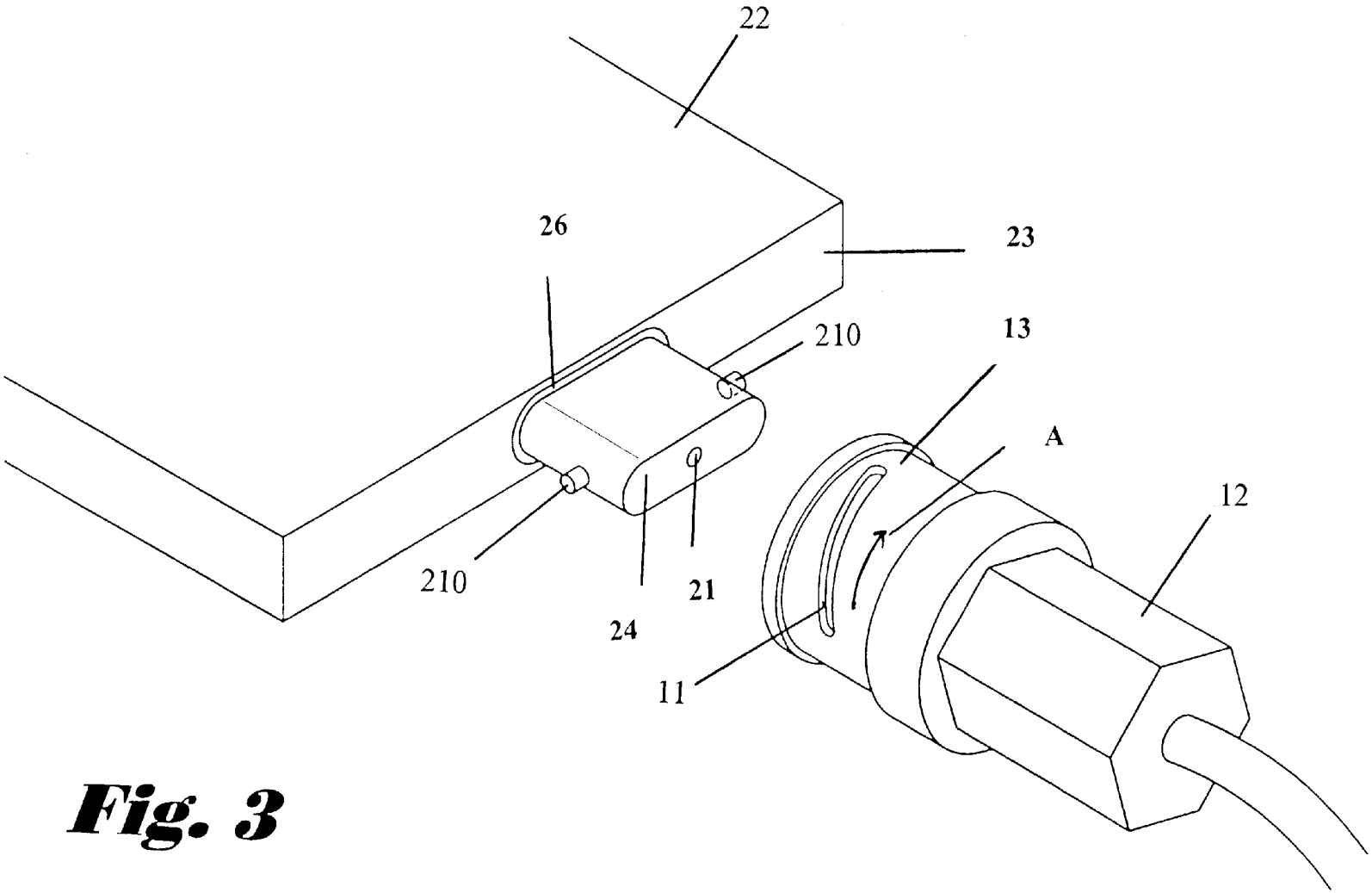
FIG. 3 is an exploded perspective view of the PCMCIA card with a fully extended external BNC receptacle connector constructed using an oblong shape.

The BNC receptacle body is shown in its extended position in FIG. 3. After ejecting the receptacle body 24, the user inserts the two projections 210, which attach to the surface of the BNC connector body 24. These projections then fit inside the guide holes 11 in the BNC connector shielding 13. Then, the external BNC connector 12 is rotated in the direction of arrow 'A' and the PCMCIA card, by way of its BNC connector receptacle 21, and external BNC connector are fully engaged.

Figure 4:
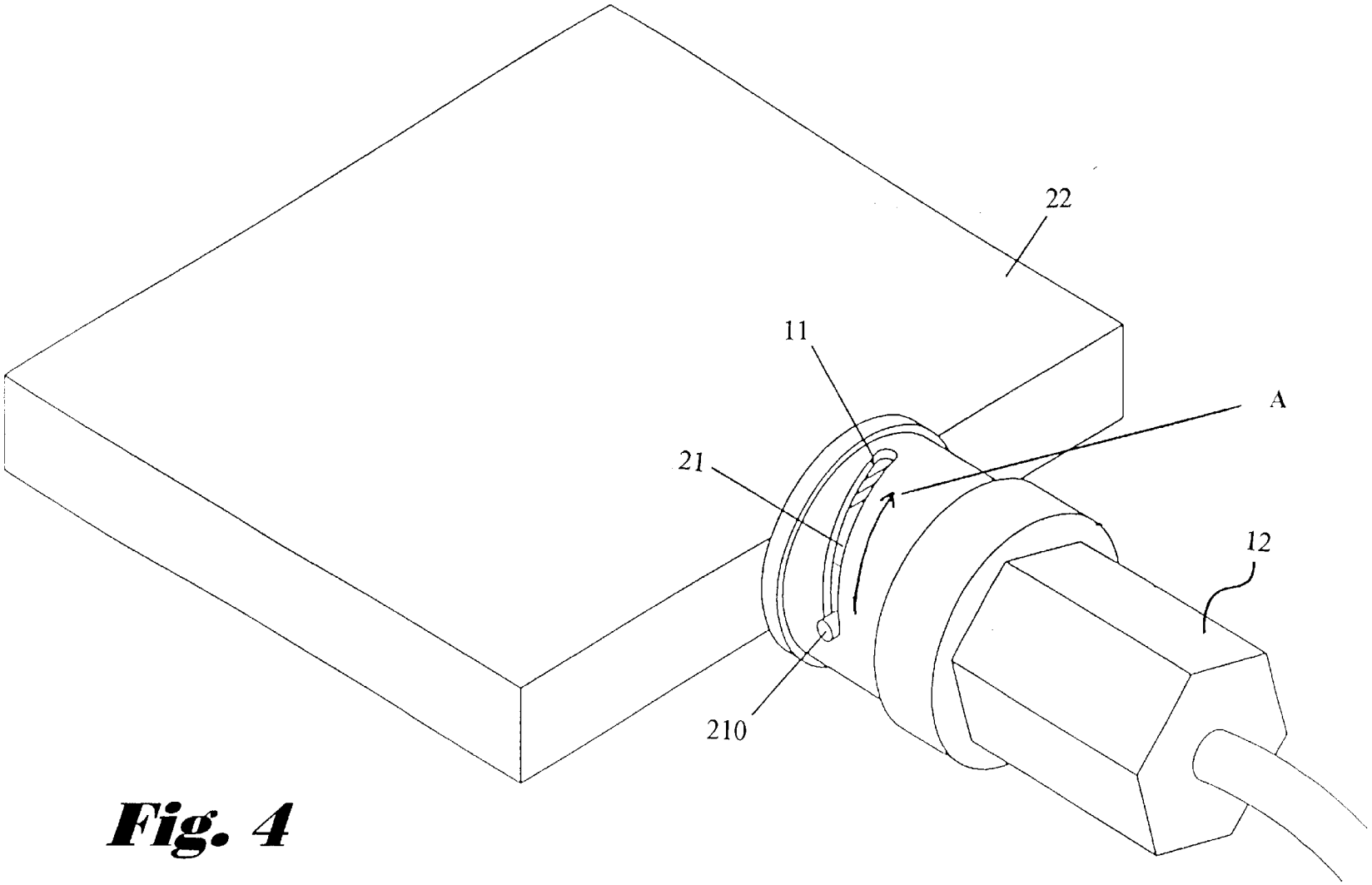
FIG. 4 is a perspective view showing the connection between a PCMCIA card and an external BNC connector, which is attached to the BNC connector receptacle.

FIG. 4 shows a PCMCIA card 22 directly mated to a BNC connector 12. This PCMCIA card can now be inserted into a PCMCIA slot, of a matching type, to interface the computer with an external device. The retractable BNC connector receptacle 21 has two projections 210 on both sides of its body.

Figure 5:
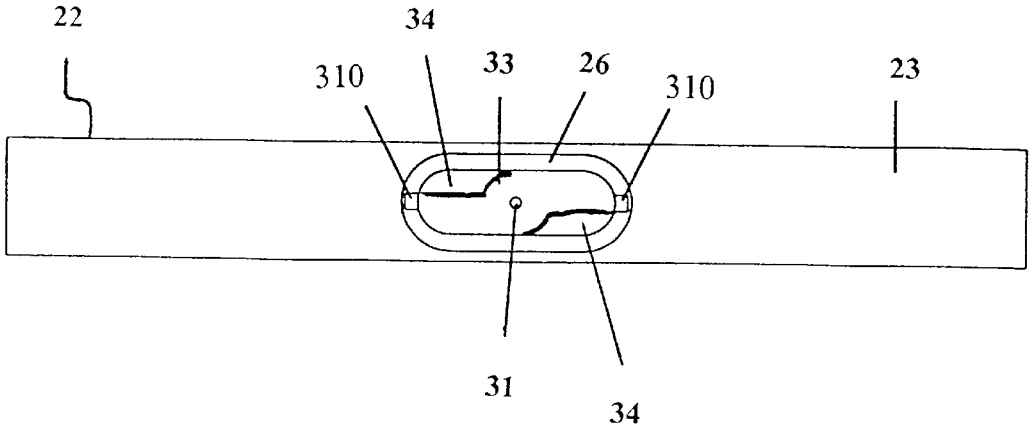
FIG. 5 is a front view of the PCMCIA card with a retracted X-shaped BNC connector receptacle.
Figure 6:
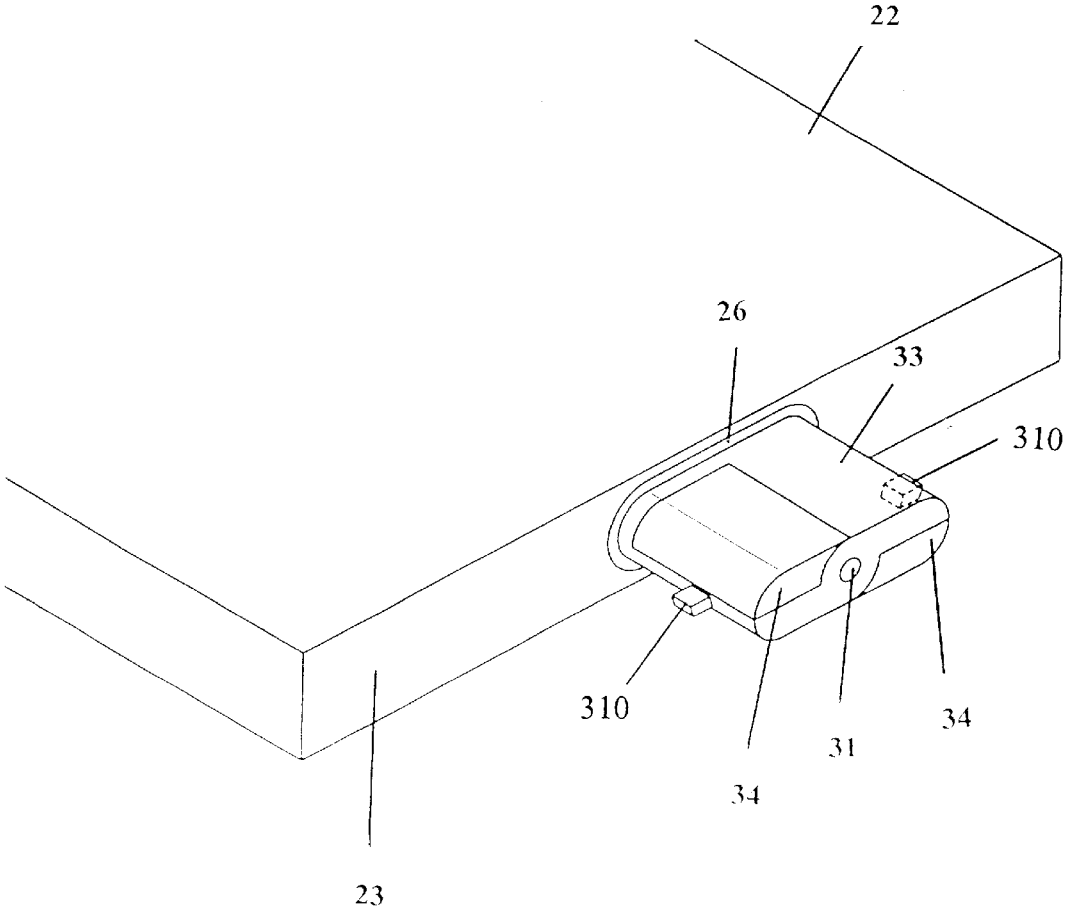
FIG. 6 is a perspective view showing a BNC connector receptacle that can be transformed into an x-shaped receptacle and then attached to a BNC connector.

A second embodiment of the current invention uses an X-shaped BNC connector receptacle. FIG. 5 shows the X-shaped BNC connector receptacle 31 fully inserted inside the PCMCIA card 22. The BNC connector receptacle is extended when the user pushes on the receptacle body, which is composed by members 33 and 34. FIG. 6 shows the connector receptacle 31 projected out of PCMCIA card 22. In this figure the receptacle body is in its original cylindrical shape. To adopt its X-shape, the user must rotate member 34 around the center axis of the receptacle body so as to separate the ends of members 33 and 34.

Figure 7:
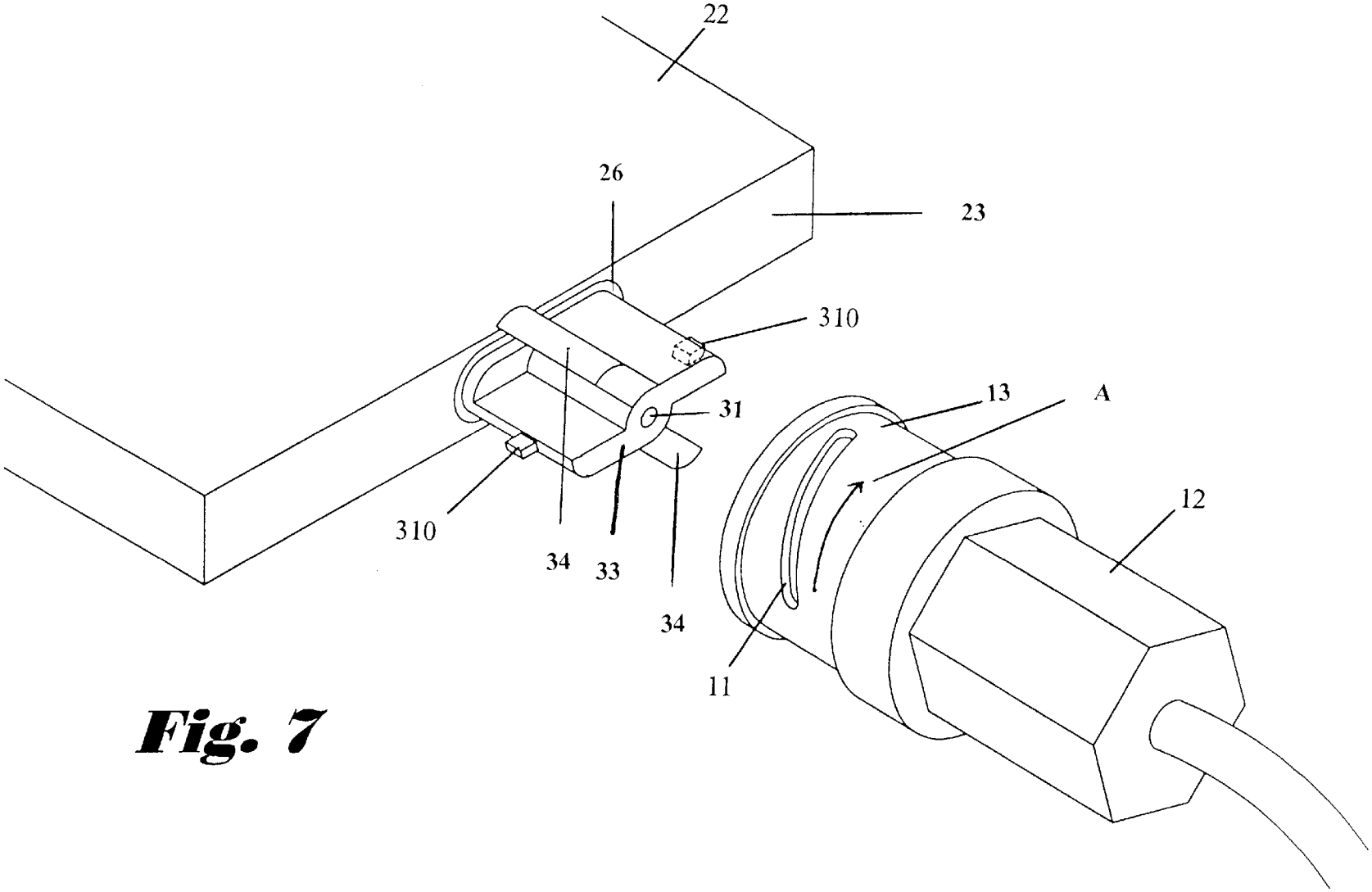
FIG. 7 is an exploded perspective view of a PCMCIA card and an external BNC connector, which will be attached to an X-shaped BNC connector receptacle.
Figure 8:
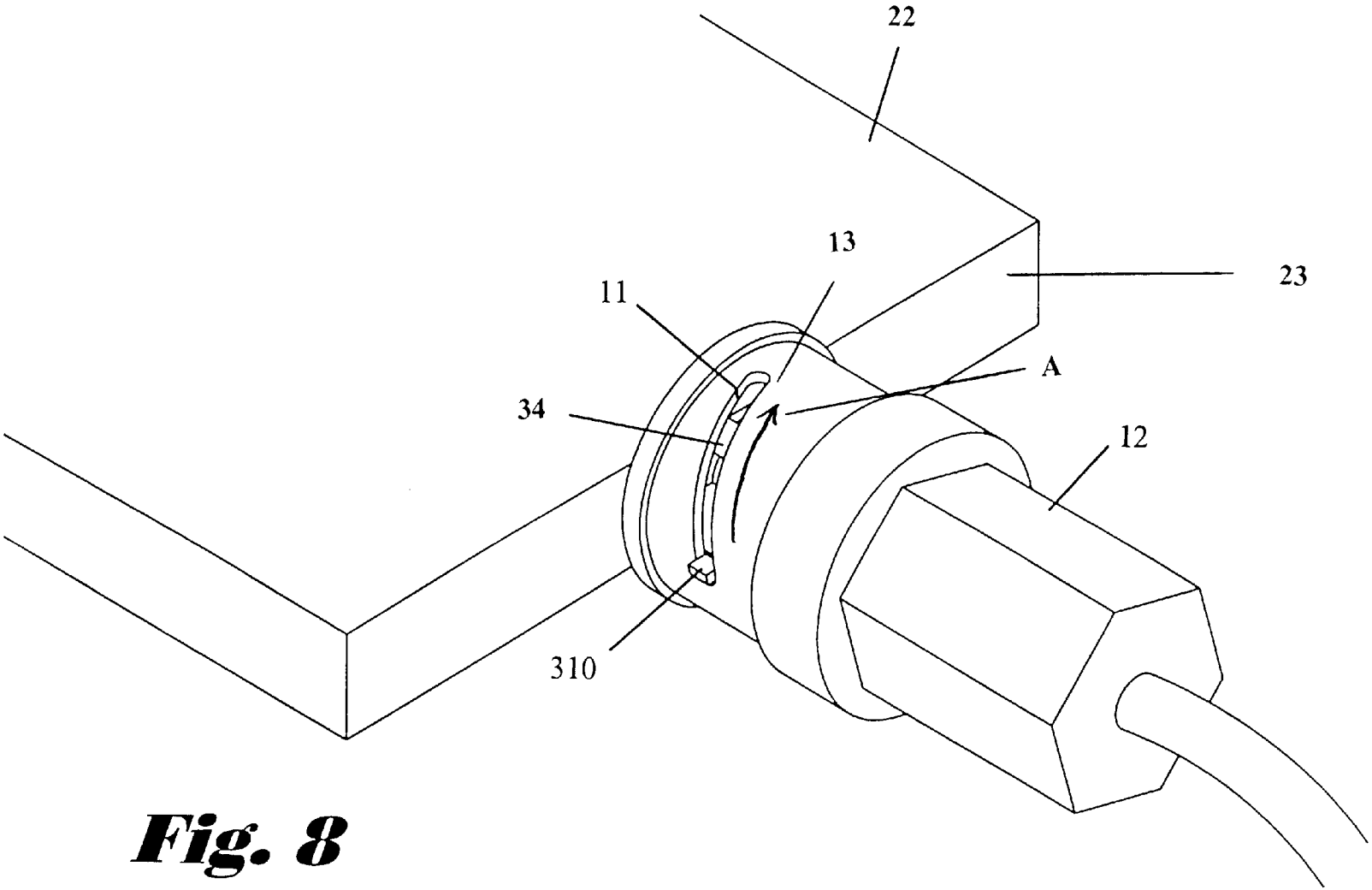
FIG. 8 is a perspective view of a PCMCIA card, with an X-shaped BNC connector receptacle, engaged with an external BNC connector.

FIG. 7 shows a PCMCIA card with an X-shaped receptacle body. The members composing the BNC receptacle body were separated and rotated to form the X-shaped body of the BNC connector receptacle 31. The receptacle 31 has two projections 310 which attach to the surface of body member 33. As is shown in FIG. 8, after the user attaches the two projections 310 to member 33, they are inserted inside the guide holes 11 in the BNC shield 13. Then, the external BNC connector 12 is turned in the direction of arrow 'A' and the PCMCIA card, by way of its BNC connector receptacle, and the external BNC connector are fully engaged.

In both embodiments the BNC receptacle body is thinner than the PCMCIA card and is fully insertable into the body of the PCMCIA card so as to make storage easier. When transporting the connector in this fully inserted position it is easier to avoid damaging it.

Although two preferred embodiments of the present invention have been disclosed for illustrative purposes, those skilled in the art will appreciate that various modifications, additions and substitutions are possible, without departing from the scope and spirit of the invention as disclosed in the accompanying claims. It is also possible that other benefits or uses of the currently disclosed invention will become apparent over time.

What is claimed is:

1. A device, comprising:

a PCMCIA card for interfacing a computer with an external device; and a BNC connector, built into one edge of said PCMCIA card for attaching to an external BNC connector.

2. A device according to claim 1, with said BNC connector having a body that is thinner than the thickness of said PCMCIA card.

3. A device according to claim 1, further comprising said BNC connector having an oblong shape.

4. A device according to claim 1, with said BNC connector attached on an edge of said PCMCIA card, said BNC connector being retractable and extendable by a manipulation from a user.

5. A device according to claim 1, further comprising said BNC connector having a second stable shape, said second stable shape is an X-shape.

6. A device according to claim 1, with said BNC connector having a plurality of projections on its side, said projections are attached by a user and said projections are used to engage a mating BNC connector.

7. A device, comprising:

a PCMCIA card for interfacing a computer with an external device;

said PCMCIA card having a female BNC connector receptacle on an edge closest to the PCMCIA port entrance where said PCMCIA card is contained;

said female BNC connector receptacle being retractable and extendable by a manipulation from a user;

said female BNC connector receptacle having a rotable part, said rotable part forming an X-shaped member when rotated about a central pinned axis; and said female BNC connector receptacle having a plurality of projections on its side that are used to engage a mating BNC connector.

8. A process for connecting a PCMCIA card to a BNC connector, comprising the steps of:

manipulating a retractable BNC connector receptacle to extend it from said PCMCIA card;

performing any transformative steps;

inserting a plurality of projections into said X-shaped BNC connector receptacle that are used to engage a mating BNC connector; and engaging a mating BNC connector.

9. The process for connecting a PCMCIA card to a BNC connector according to claim 8, where performing any transformative steps comprises:

rotating a portion of said retractable BNC connector receptacle to create an X-shaped BNC connector receptacle when said BNC connector has a movable part that is attached to said BNC connector.

* * * * *